US005237491A

United States Patent [19]

McCarter

[11] Patent Number: 5,237,491

[45] Date of Patent: Aug. 17, 1993

[54] PERSONAL RESCUE LIGHT

[76] Inventor: Walter K. McCarter, 9481 Evergreen, No. 406, Davie, Fla. 33324

[21] Appl. No.: 972,976

[22] Filed: Nov. 6, 1992

[51] Int. Cl.[5] ..... F21L 7/00

[52] U.S. Cl. ..... 362/186; 362/205; 362/363; 362/802; 116/209; 340/815.15; 441/18; 441/36

[58] Field of Search ..... 362/205, 186, 802, 363, 362/84, 194, 208; 340/984, 985, 815.15; 116/209, 210; 441/36, 89, 13, 17, 18, 20; 200/61.04, 61.06, DIG. 40

[56] References Cited

U.S. PATENT DOCUMENTS

| | | | |
|---|---|---|---|
| 1,676,977 | 7/1928 | Blair | 362/186 |
| 2,305,490 | 12/1942 | Perkins | 362/186 |
| 2,765,481 | 10/1956 | Manhart et al. | 441/17 |
| 3,181,135 | 4/1965 | Zoglio | 340/815.15 |
| 3,264,463 | 8/1966 | Bonner, Jr. | 362/186 |
| 5,034,847 | 7/1991 | Brain | 362/205 |

FOREIGN PATENT DOCUMENTS

| | | | |
|---|---|---|---|
| 208195 | 8/1990 | Japan | 447/17 |

*Primary Examiner*—James C. Yeung

*Attorney, Agent, or Firm*—Malin, Haley, DiMaggio & Crosby

[57] ABSTRACT

An improved personal rescue light attachable to a life vest or raft for use by an individual floating in a large body of water (salt or fresh) having increased visible range especially with fresh water usage. The device includes a water-activated battery and improved battery housing that increases the battery efficiency to produce more power for an incandescent lamp that provides a single source of light through a lens providing for a very narrow, intense beam of light, greatly increasing the overall candle power of the projected light beam.

3 Claims, 5 Drawing Sheets

PERSONAL RESCUE LIGHT

BACKGROUND OF THE INVENTION

1. Field of the Invention

This invention relates generally to a personal rescue light that can be attached to a life vest or raft to aid rescue crews in locating survivors of aircraft or ship accidents who are lost in a large body of water, and in particular, to an improved personal rescue light that can provide a highly intense, narrow incandescent beam of light that is observable up to a mile utilizing a battery activated by salt or fresh water.

2. Description of the Prior Art

Personal rescue lights are known in the prior art. A plethora of portable survival lights have been produced that may be either of the incandescent or strobe variety that include dry cell batteries of numerous sizes and shapes. ACR Electronics, Inc., has manufactured and sold for several years a rescue light comprised of a small incandescent bulb, placed within a lens, that is powered electrically by a battery contained in a water tight housing. Once a plug on the housing is removed and the battery immersed in water, water enters the housing of the battery cells as electrolyte, activating the light. Although these lights have been very effective over the years for rescue, increasing the visible range and directional area of visibility without increasing size, bulk and weight is desirable.

The present invention provides an improved personal rescue light that achieves increased incandescent light visibility range and directional area by employing an improved lens design that acts integrally with an improved water-activated battery system resulting in more power to the incandescent lamp without weight or size increase.

SUMMARY OF THE INVENTION

A personal rescue light comprising an incandescent single point light bulb mounted within a clear plastic or glass lens optically designed for light ray dispersion so that the single point light bulb filament is mounted at the focal point of the lens. The lens projects a very narrow (approximately 2°) light emanating for 360° around the lens body midsectionbeam horizontally and in an upward conical beam vertically from the top of the lens (dome).

The incandescent single point bulb is powered by a small lightweight battery, mounted in a waterproof plastic housing having first and second apertures that permit water flow into the housing when the aperture sealing plugs are removed and the housing is immersed in fresh or salt water. A pair of electrical wires connect the battery to the light bulb, all components of which are essentially waterproof. The waterproof battery housing first and second apertures include an upper gas ejecting aperture and a lower sludge outlet aperture, which allows water, whether salt or fresh, to flow through the battery. The battery plates are separated by channels that direct self-generated gas bubbles which affect the activation of the battery and its operational efficiency. By providing first and second housing apertures of different diameters of predetermined ratios based on the overall size and spacing of the battery plates in the housing, a desired electrolyte flow rate can be determined to get the maximum voltage and current from the battery which results in increasing the power to the incandescent lamp when the battery is actuated, resulting in greater candle power.

The light beam emanating from the incandescent lamp in conjunction with the dome lens provides approximately a 2° beam, 360° around the lens in a horizontal plane. The overall effect of using the improved battery with the improved lens is a 2¼ candle power light which improves the visual range of the device, especially when used in fresh water, without size or weight increase, thus improving the available area of visibility.

The lens, which is preferably made of an optically clear plastic, has a partially truncated spherical exterior appearance with a bulbous dome and includes a cylindrically-shaped interior chamber and a flat chamber top end wall. The lens has a strategically designed exterior surface contour and lens body thickness optically determined that is based on the center of the lens chamber cylinder as a focal point, a predetermined distance from the base opening of the lens chamber, to create a 2° light beam about a central plane that is perpendicular to the longitudinal axis of the cylinder forming the inside chamber of the lens. When the incandescent single point light source is positioned at the focal point, an intense light beam is transmitted for 360° that is visible under selected ambient conditions for at least one mile.

The incandescent light bulb fits into a disc-shaped lens mounting plate having a central passage that receives the tubular incandescent bulb therethrough and an annular channel that receives the base of the lens for sealed mounting to waterproof the lens interior. The lens mounting plate central passage also acts to spatially align the longitudinal axis of the incandescent bulb so that the point source of light, once the bulb is mounted, is longitudinally axially aligned with the focal point of the lens housing to provide the maximum visibility distance for the lens. A circular cover that attaches to the mounting plate is used to enclose the wire connections from the bulb to the battery. The cover includes a guide post that aligns the light bulb and its filament longitudinally to the focal point. Finally, the lens mounting plate has small holes for a connecting line or cord that allows the light to be attached to a life jacket or raft for maximum security to prevent loss of the light due to wave action.

The battery housing is quite small (about 3.5 inches long), including the lightweight battery plates (51 grams), and is made of a durable water proof plastic. The battery plates inside the housing are kept dry (no electrolyte) until the light is to be illuminated, and can only be activated by admission from the outside of a liquid such as fresh or salt water. Therefore, the battery housing includes first (upper) and second (lower) apertures of different diameters, both of which are sealed by removable plugs. To illuminate the light, the plugs are removed and the battery housing immersed in water. Once immersed, the housing upper aperture acts as an inlet for water and is an outlet for gas bubbles which are generated internally and rise to the top of the housing. The housing lower aperture lets in water and is an outlet for sludge removal. Sludge is created as a by product of the battery action as small particulates are formed that can reduce battery efficiency. The apertures are disposed diametrically from top to bottom across the rectangular housing for operational internal flow-through of electrolyte from one end of the battery housing to the other. The battery plates (anode and cathode) in the housing are separated by channels that allow water (the electrolyte) to flow from one end to the other by gravity. The housing aperture diameters are such that the gas bubble action inside the battery created by electrolyte contacting the plates acts to enhance the galvanic interaction in the battery by slowing flow through the battery housing to increase the electrolytic current flow. The light bulb is connected to the cathode and anode plates of the battery by a pair of plastic covered waterproof wire conductors.

A pair of removable plastic water tight plugs are mounted in a sealed relationship in the upper and lower apertures and the plugs are connected together by an elongated plastic member that acts as a plug holder and pull handle (especially with gloves on) for popping the plugs out when necessary to activate the light. Once fresh or salt water is allowed into the housing to contact the plates, the current flow will illuminate the light continuously for several hours.

The personal rescue light described in this invention is particularly useful for a downed aviator or shipwrecked mariner floating in a large body of water. A person in the water is very difficult to find in the daytime and even more difficult to find at night. A single person in a raft or floating in the water without a light is especially difficult to locate from search and rescue aircraft flying over large areas of open water.

To illuminate the light bulb in accordance with the present invention, a person manually removes the plugs on the battery housing and immerses the battery housing in either fresh or salt water for activation. Once water is received into the battery housing and an electrolyte established, the battery has an intended useful life of approximately eight hours. The light lens, bulb and mounting plate are typically attached to a life vest or to a portion of a raft. The lens is usually mounted on the vest or raft so that the plane of the lens mounting plate is parallel to the surface of the earth insuring that the intense light beam is projected toward the horizon in a 360° angle around the user. Rocking movement of the light can create a useful flashing effect. With the narrow beam of the present invention in conjunction with improved battery operation, the visible range (luminous intensity) is enhanced by approximately 2¼ times, resulting in 2.5 candela for salt water and 1.75 candela for fresh water.

The efficiency of construction and manufacture of the present invention is also enhanced by providing a lens mounting plate and plate cover post that direct and position the incandescent bulb such that when the incandescent bulb is inserted and mounted permanently into and attached to the lens mounting plate by the plate cover, the point source of light coming from the light bulb filament will be mounted at the focal point of the lens.

Another important aspect of the lens is to project equal light intensity along a very narrow beam (plus and minus 1°) in a plane perpendicular to the vertical axis of the lens and parallel to the plane of the mounting plate. Based on the lens design and battery size, the present invention greatly increases light intensity using the same size and weight battery as known before, especially in fresh water.

The battery operation is enhanced by restricting gas bubble flow through and out of the battery housing using a small upper battery housing aperture, enough to retard flow sufficiently so that the water electrolyte will maintain a greater ionic balance between the internal plates of the battery, generating more output current. The battery improvement is greatly enhanced relative to fresh water operation since fresh water does not have the ionic elements which are commonly found in salt water.

It is an object of this invention to provide an improved personal survival light using a single source incandescent bulb with an improved battery for brightness.

It is another object of this invention to provide a lightweight hand-held water-activated rescue light for individuals, particularly useful for attachment to a life vest or a raft that has improved brightness based on an improved lens and battery actuation.

It is another object of this invention to provide an improved personal rescue light that has increased efficiency in its manufacture, resulting in a more reliable product in less time for cost effectiveness.

In accordance with these and other objects which will be apparent hereinafter, the instant invention will now become described with particular reference to the accompanying drawings.

DESCRIPTION OF THE PREFERRED EMBODIMENTS

Figure 1:
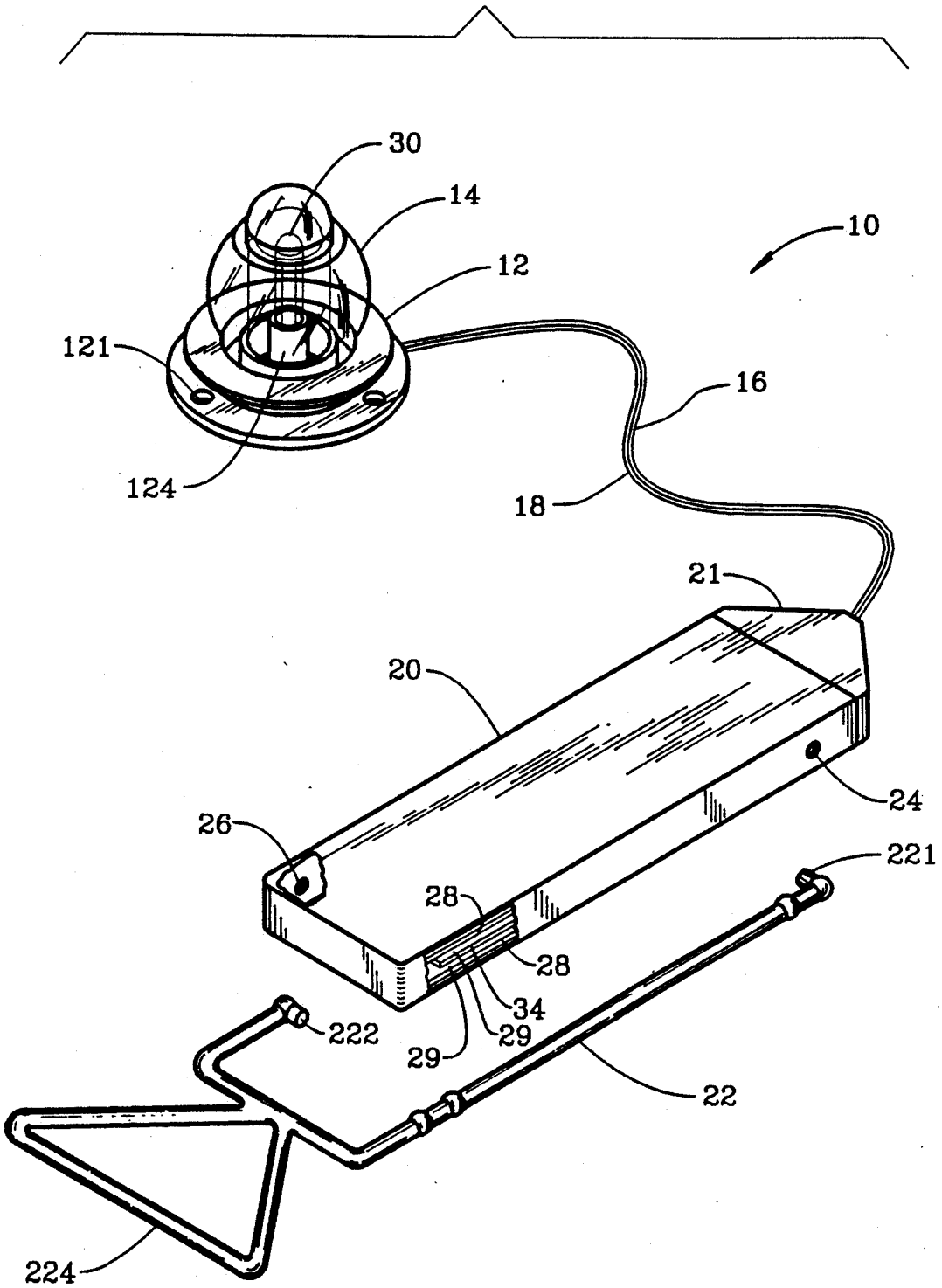
FIG. 1 shows a perspective view, partially exploded, of the present invention.

Referring now to the drawings and particularly FIG. 1, the present invention is shown, generally at 10, as a personal rescue light comprising an incandescent, single point light source 30 mounted in a clear, plastic waterproof lens 14, all of which is sealably attached to a lens mounting plate 12. A water-activated battery is provided in a battery housing 20. The battery housing 20 is substantially rectangular in shape, made of a durable, hard exterior plastic that is waterproof. The battery housing 20 contains battery elements inside such as a single plate cathode 34 made of cuprous iodide and sulphur separated by spacer electrolyte receiving channels 29 on each side from a pair of magnesium alloy plate anodes 28 mounted on both sides of cathode 34. Conductive wires 16 and 18 (surrounded by protective insulation) connect the incandescent light bulb 30 with the cathode 34 and anodes 28 mounted inside the battery housing 20. The housing top 21 provides an entrance The battery housing 20 includes two different sized apertures 24 and 26 which provide access from the ambient exterior environment to the interior of the battery housing 20 to allow water to be received into the housing 20 when a pair of sealing plugs 221 and 222 which normally keep water out are removed from apertures 24 and 26 respectively. A triangularly shaped handle 224 is integrally formed with the elongated "L"-shaped plug harness 22 for pulling and extracting the plugs 221 and 222 out of the housing apertures 24 and 26 when the user decides to activate the light by immersing the battery housing 20 in water. The plugs are shown in FIG. 1 as plugs 221 and 222 in the removed state, separated from apertures 24 and 26 respectively. The plugs 221 and 222 are always left in position in apertures 24 and 26 respectively in housing 20 until the light is to be used to prevent moisture, liquids or water from entering the housing 20 prematurely.

The clear plastic lens 14 is optically shaped to project a specifically sized and directed beam of light 360° circumferentially from the lens 14 in a plane parallel to the base surface of lens mounting plate 12 and in a narrow cone vertically through the lens upper dome. The lens 14 is firmly attached and sealed by adhesive to plate 12. The mounting plate 12 is typically tied by string (not shown) through holes 121 to a life vest or raft (not shown). When plugs 221 and 222 are removed by pulling on handle 224, disengaging the entire harness 22 from housing 20, and the housing 20 is immersed in either fresh or salt water, water entering the housing 20 creates the electrolyte in the passages 29 between the anodes 28 and cathode 34, activating the battery and powering the light bulb 30.

Figure 2:
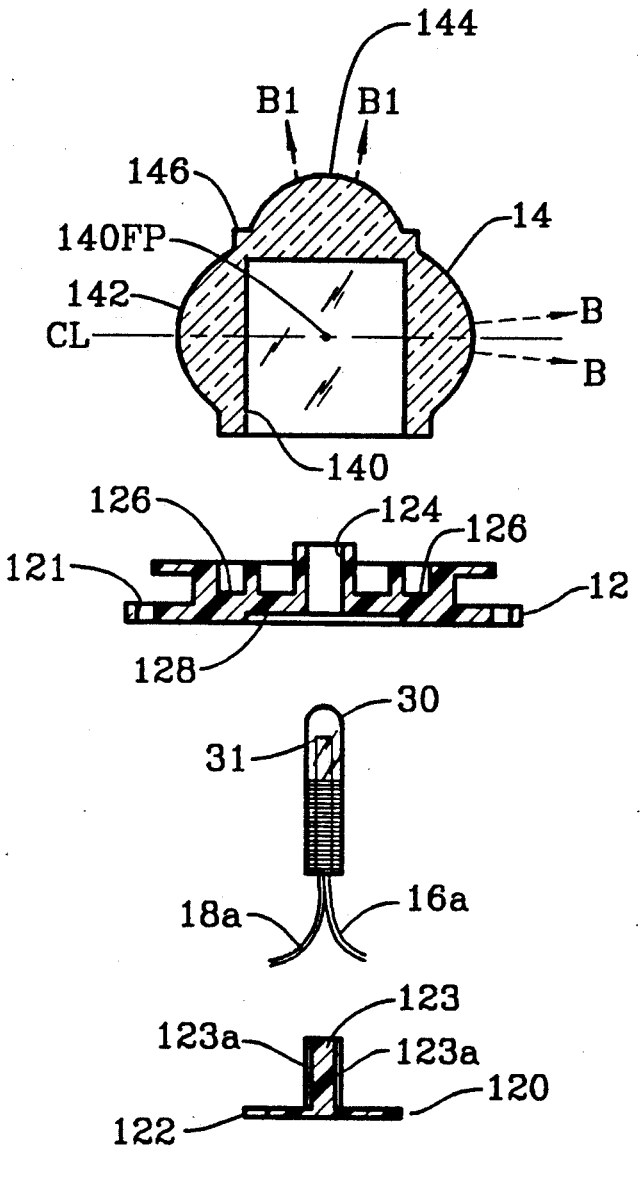
FIG. 2 shows a cross sectional view in elevation of the present invention with respect to the light source, bulb and lens, used in the present invention.
Figure 3:
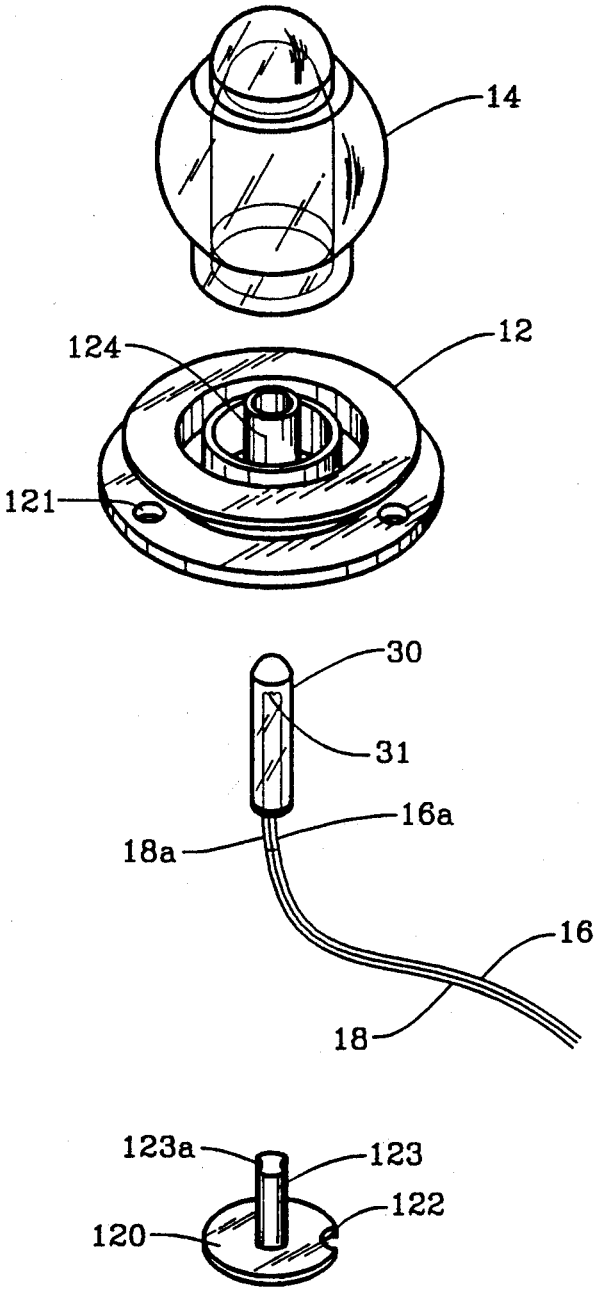
FIG. 3 shows an exploded perspective view of the lens, the lens mounting plate bulb, and plate cover utilizing the present invention.

Referring now to FIGS. 2 and 3, the lighting components of the invention are shown. The single light source is an incandescent light bulb 30 that includes conductors 16*a* and 18*a* which connect to the small filament 31 which is the single source, single point of light rays for the bulb. The light bulb 30 is sized in length (tubular shape) to fit on top of post 123 connected in the center of circular cover 120 through passage 124 in the lens mounting plate 12 so that the single point source caused by filament 31 is precisely located at point 140 FP inside lens 14 which is the focal point of the lens 14. In the preferred embodiment, the lens body is made of a clear acrylic plastic of a predetermined index of refraction and includes an interior cylindrical chamber 140 that receives the incandescent light bulb 30. The lens 14 is sealably mounted in an annular channel 126 disposed on the top surface of the lens mounting plate 12. The lens 14 is permanently attached by heat or adhesive and sealed in channel 126 so that the connection is waterproof. The lens mounting plate 12 also includes a plurality of apertures 121 around an outer edge area that can be used to tie or secure the light bulb and lens 14 to a life vest or raft (not shown). A small mounting plate cover 120 is adhesively attached to an annular indented chamber 128 for sealing the bulb conductors 16*a* and 18*a* inside the lens 14 and lens plate 12 and allowing the main conductors 16 and 18 (shown in FIG. 1) to be sealably connected to the light filament 31 inside the bulb 30 through conductors 16*a* and 18*a*.

FIG. 2 also shows a pair of beams B emanating on either side of a center line CL which indicate the beam width around the lens 14 when it operates relative to the focal point 140 FP. There is also an additional 6° cone of light rays B1 that emanate out of the top of the lens housing 144. The interior cylindrical chamber 140 of lens 14 in conjunction with the lens body thickness and exterior contour and shape of surface 142 in accordance with a predetermined lens equation provide for a very concentrated 1° beam of light on either side of the center line CL around the exterior lens 14. The center line CL is perpendicular to the central longitudinal axis of the internal cylinder 140 and if rotated defines a plane that intersects the largest circumference (the equator line) of the exterior spherical body portion of the lens 14. An annular 90° ring is disposed around the top portion of the lens 146 separating the dome 144 from the circular side wall exterior surface 142. By focusing the light beam within a 1° beam on each side of the center line, the visibility range of the light and therefore the probability of finding someone is increased. The lens mounting plate cover 120 that attaches into the lens plate chamber 128 has a small recessed opening 122 that allows the exterior insulated (plastic covered) electrical conductors 16 and 18 to pass into chamber 128 where the wire conductors are connected to the light bulb 30, the wires being attached to the incandescent light bulb conductors 16*a* and 18*a* inside chamber 128, all of which is surrounded and packed in a waterproof adhesive material that seals cover 120 into chamber 128.

FIG. 3 shows the cylindrical, elongated tubular shape of the light bulb 30. The partially circular, recessed indentation 122 receives the wires 16 and 18. The longitudinal length of passage 124 that is integrally formed in the lens mounting plate 12 is of a specifically predetermined distance such that the filament 31 is located precisely at the focal point 140 FP of the lens 14 when the bulb 30 is mounted on top of post 123 with conductors 16*a* and 18*a* separated by post 123 in side grooves 123*a* which receive and separate the conductors 16*a* and 18*a*. The length of post 123 when cover 120 is secured in chamber 128 is such as to position the filament 31 at the lens focal point 140 FP with the bulb 30 partially in passage 124. The post 123 facilitates construction by insuring that the bulb is properly positioned during installation.

Figure 4:
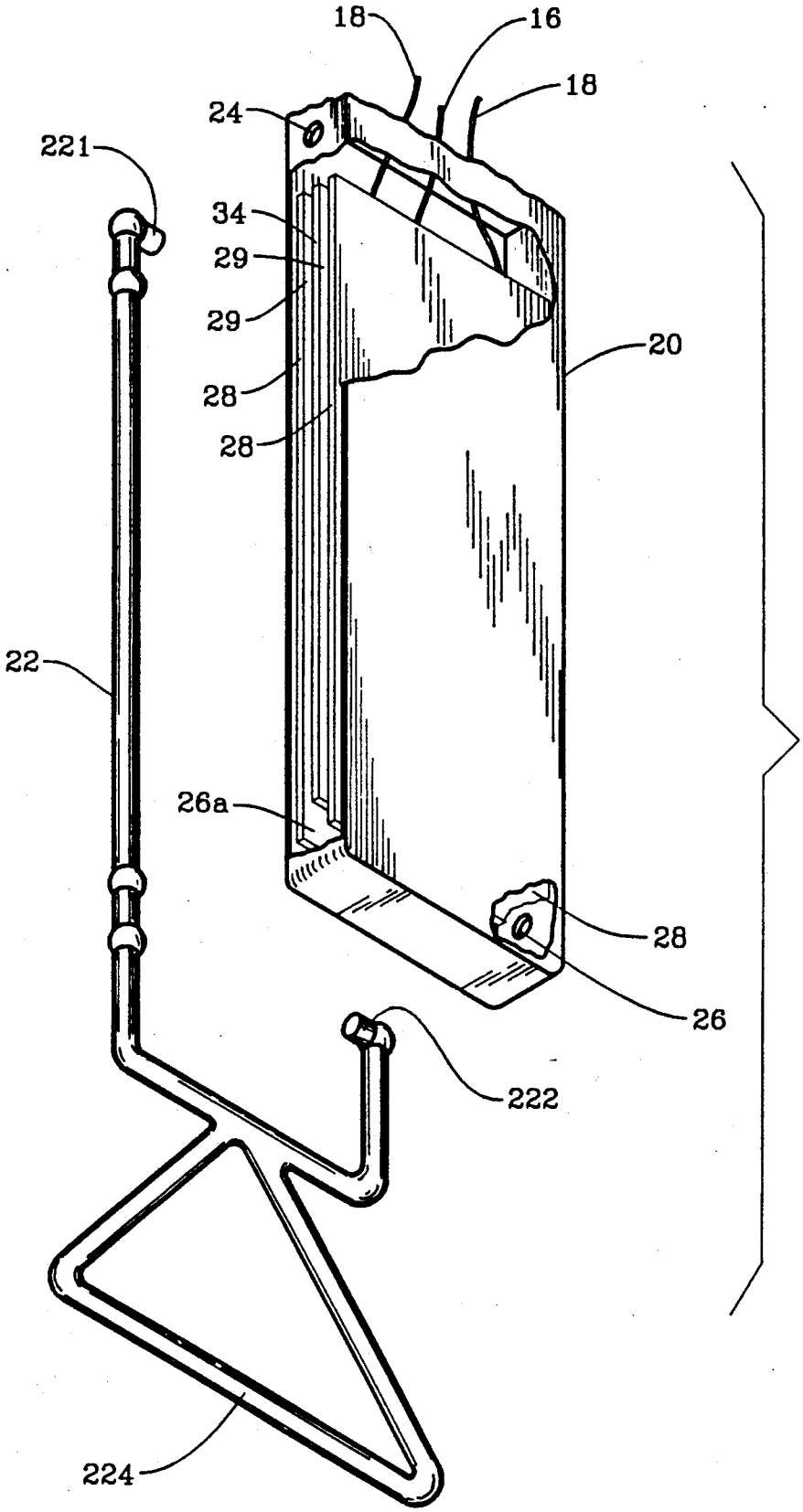
FIG. 4 shows a perspective view, partially cut away, of the battery housing and removable sealing plugs and attachment harness utilized in the present invention.

Referring now to FIG. 4, the harness 22 which may be made of a lightweight, sturdy, flexible plastic includes battery housing sealing plugs 221 and 222 in conjunction with a pull handle 224 which allows a person wearing gloves to manually remove the plugs. The truncated upper portion of the housing 21 (FIG. 1) is not shown in FIG. 4. Also, the forward facing end side wall has been cut away to allow a view into the housing 20. Shown inside the battery housing 20 are a cathode 34 which is represented by a flat thin plate 34 which could be cuprous iodide and sulphur, and a pair of parallel flat thin plate anodes 28, on each side of the cathode 34, each made of a magnesium alloy. The plate cathode 34 is shorter in length than the longer plate anodes and is shorter in length leaving a passage 26*a* in the housing 20 bottom for water (electrolyte) flow to the lower aperture 26, which is described in more detail below. As stated above, to activate the battery, the housing 20 (with the plugs 221 and 222 removed) is immersed in fresh or salt water. The apertures 24 and 26 provide access into the battery housing 20 that allows water to flow in and pass between the cathode 34 and the anodes 28 acting as an electrolyte. The conductors 16 and 18 are electrically connected respectively to the cathode 34 and anodes 28. The housing 20 shown in FIG. 4 is oriented substantially vertically relative to the surface of the earth so that gravity acts downwardly vertically on the housing. After the plugs 221 and 222 are removed and the housing immersed in either fresh or salt water, water will enter apertures 24 and 26 and interact with the cathode 34 and the magnesium alloy anode plates 28 in the passageways disposed therebetween. Gas bubbles will form internally and generally rise by buoyancy in the electrolyte for ultimate expulsion from the housing 20 through upper aperture 24. Likewise, magnesium hydroxide sludge, which forms due to the electrolytic action between the plates, will fall by gravity into lower passage 26a for ultimate expulsion through lower aperture 26.

One of the very important improvements in this invention is the modification of the housing 20 such that aperture 24 is reduced in diameter size to limit the amount of gas bubbles that can escape per unit time through aperture 24 to the outside of the housing 20. By limiting the amount of gas expulsion per unit time and delaying gas expulsion, a greater electrolytic action can take place within the battery housing by the water (especially for fresh water) contained, because the electrolyte is retained longer in the housing 20. The lower housing aperture 26 is sized in diameter to permit the discharge of sludge particulates which would otherwise diminish battery output by interfering with the electrolytic action within the battery housing. In the preferred embodiment, the upper aperture is 0.070 inches in diameter and the lower aperture is 0.125 inches in diameter.

The electric rate of discharge of 200 milliamps (battery action) is created with cathode 34 made of a single cuprous iodide and sulphur plate four square inches and 0.125 inches thick and two magnesium alloy plate anodes 28 being approximately 0.030 inch thick. Channels of 0.040 inches provide space between the cathode and the anodes on each side from top to bottom and allow for water flowing in the housing to interact in conjunction with the gas bubbles which rise to the top and finally exit out aperture 24. It is essential that there be a larger aperture 26 at the bottom of the housing to permit the larger elements of sludge (formed from magnesium hydroxide) which are pulled down by gravity to exit the bottom. Applicant has found by making the aperture 24 sufficiently small to allow some hydrogen gas bubble build up in the top portion of the housing 20 with electrolyte level maintained at the top of the cathode, the battery (for a given size) increases its output and efficiency to produce more current to drive the light, thereby making for a brighter incandescent light bulb 30. Internal pressure in the housing 20 pulsates due to the gas pressure as gas builds up and discharges periodically through aperture 24. The gas bubble resistance due to build up restricts water flow through the housing enhancing electrolytic actions, without curtailing battery action. Once reaching a gas pressure above ambient, the gas is discharged and water flows in aperture 24 for a short time period.

Figure 5:
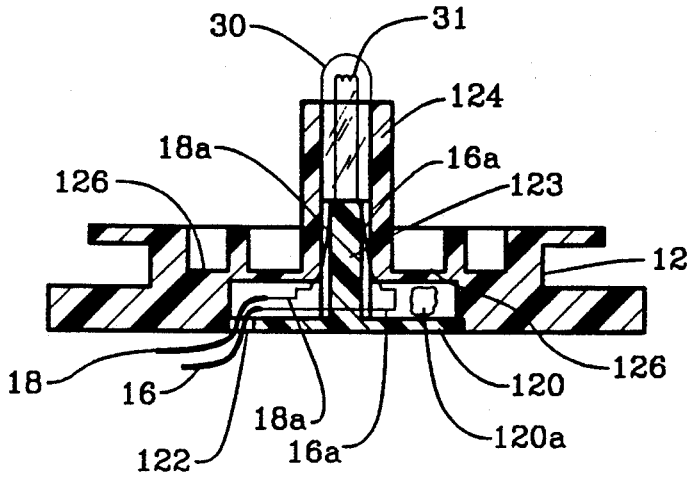
FIG. 5 shows an enlarged cross sectional view in elevation, showing the incandescent bulb and bulb housing.

FIG. 5 shows the connection of the incandescent bulb 30 to conductors 16a and 18a and the strategic bulb size relative to passage 124. Bulb 30 is firmly locked in place in passage 124 by cover 120 and cover post 123 with conductors 16a and 18a spread apart along opposite sides of post 123. In chamber 126 which is filled with an adhesive 120a (shown partially filled) the conductors 16a and 18a are connected to external conductors 16 and 18. Due to bulb length, filament 31 is disposed above the top of passage 124 at the focal point of lens 14. Plastic coated conductors 16 and 18 emerge from recess 122 located at one edge of the cover 120.

Figure 6:
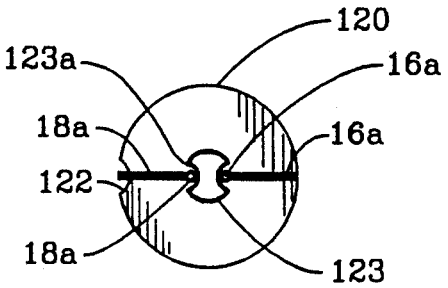
FIG. 6 shows a top plan view of the incandescent bulb cover and guide post used for the present invention.

FIG. 6 shows the light filament conductors 16a and 18a which emerge from the base of light bulb 30 on each side of openings 30a at the base of the light bulb separated by insulating plastic post 123 in grooves 123a.

Figure 7:
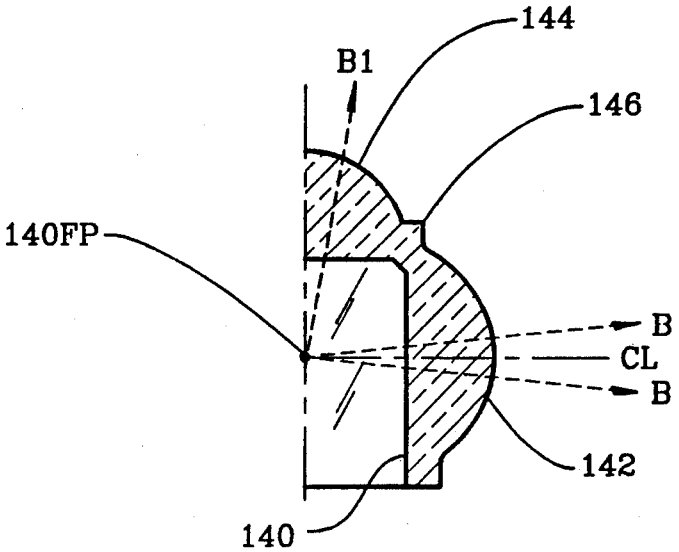
FIG. 7 shows a side elevational view, enlarged, of one-half of a clear plastic lens used in the present invention. The other half is identical.

FIG. 7 shows an enlarged one-half (in actual proportion) cross sectional segment of the lens 14. The focal point 140 FP is determined by a lens equation in relationship to the optically clear plastic (or glass) material used, the thickness between curved wall 142 relative to the cylindrical interior chamber wall 140 to project a 1° beam of light on either side of center line CL circumferentially in a plane of the center line, 360° around the lens as emanating from the focal point 140 FP. In addition, an upper cone of light is projected (that may be 6°) that goes through the dome 144 emanating from the focal point, perpendicular to the center line plane. Thus, the lens 14 projects a very concentrated beam in a narrow plane perpendicular to the vertical axis for 360° around the lens and in a vertical, narrow cone above the lens.

By improving the efficiency of the battery without increasing size or weight, and especially by restricting the escape of gas bubbles per unit time and by enhancing sludge flow through aperture size in the battery housing, in conjunction with a lens design to project a plus or minus 1° beam, enhanced operation in fresh and salt water resulting in increased visual distance in the form of a projected beam of 2¼ candle power is achieved from a 0.1 candela bulb.

The battery electrolyte action (electrical rate of discharge) and lens improvements are of great significance for stranded aviators or mariners who are lost at sea. A large body of water is the toughest place on the planet Earth to survive. Lack of fresh drinking water, lack of dry provisions, and exposure to the elements such as sun, makes survival at sea extremely difficult. Search and rescue personnel find it difficult to see a single person floating in the water, even in a raft. The use of a personal light at night as a single point of light to identify the location of someone lost at sea is extremely important. The narrow beam has the effect of flashing with small movements of the light.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A personal rescue light to aid in locating a person, particularly in a large body of salt or fresh water, floating in the water or in a small raft, comprising:

an elongated incandescent light bulb having a single source point of light and electrical conductors;

optical lens having a transparent body, said body having an inside chamber, an outside configuration to produce a narrow beam, said lens body made of a light refracting material, said lens producing a substantially narrow, less than 3° beam of light, circumferentially around said lens in a predetermined plane;

lens mounting plate for mounting said lens body including a center portion for holding said incandescent bulb in a predetermined position and a lens body channel for receiving a predetermined portion of said lens body for sealably attaching said lens to said lens mounting plate;

lightweight, water-activated battery, operational in fresh or salt water having principal electrical conductors, said lens mounting plate having a lower chamber sized for connecting said bulb electrical conductors in said incandescent bulb to said principal battery conductors for attachment, said incandescent light positioned relative to said lens plate and said lens positioning said filament in a predetermined position, said lens having a focal point at the same point as said incandescent light single source;

waterproof housing containing said water-activated battery, said waterproof housing having a first aperture and a second aperture, said first aperture located away from said second aperture and having a different diameter size, said first aperture sized for restricting gas flow at a predetermined rate from said first aperture, said second aperture sized for allowing internal battery sludge to flow out from said housing; and means for plugging said first and second battery housing apertures removably; whereby when said housing plugs are removed and said battery housing is immersed in salt or fresh water, said incandescent light will illuminate.

2. A personal rescue light as in claim 1, wherein said lens includes a cylindrical interior chamber that contains the focal point of the lens and is sized to receive the incandescent light bulb, said lens being constructed of an acrylic clear plastic having an index of refraction of a predetermined value and an exterior contour shape disposed on either side of a center line plane circumferentially relative to the focal point of the lens to produce an extremely narrow (plus or minus 1°) beam on either side of a center line plane passing through the focal point of the lens to greatly increase the candle power of projected beam.

3. A personal rescue light as in claim 1, wherein said water-activated battery includes at least two plates separated from each other and mounted within said battery housing to provide a water flow channel between said plates in fluid communication between said housing first aperture and said housing second aperture and a pair of internal fluid communicating passages at the top and bottom of said internal battery housing in fluid communication with said first aperture and said second aperture, whereby sludge can readily flow out from said second aperture and gas bubbles are somewhat restricted to enhance the action of the electrolyte within the battery housing by said first battery housing aperture.

* * * * *